US008876422B2

(12) United States Patent
Lim

(10) Patent No.: US 8,876,422 B2
(45) Date of Patent: Nov. 4, 2014

(54) AIRLESS PUMPING TYPE COSMETIC CONTAINER HAVING AN APPLICATOR

(75) Inventor: Jun-Kuk Lim, Gyeonggi-do (KR)

(73) Assignee: Toly Korea, Inc., Gyeonggi-do (KR)

( * ) Notice: Subject to any disclaimer, the term of this patent is extended or adjusted under 35 U.S.C. 154(b) by 532 days.

(21) Appl. No.: 13/267,086

(22) Filed: Oct. 6, 2011

(65) Prior Publication Data

US 2012/0321368 A1 Dec. 20, 2012

(30) Foreign Application Priority Data

Jun. 16, 2011 (KR) ..... 10-2011-0058272

(51) Int. Cl.

| | |
|---|---|
| ***A46B 11/02*** | (2006.01) |
| ***A45D 34/04*** | (2006.01) |
| ***B05C 17/00*** | (2006.01) |
| *B05B 11/00* | (2006.01) |

(52) U.S. Cl.

CPC ..... *A45D 34/04* (2013.01); *A45D 34/041* (2013.01); *A45D 2200/056* (2013.01); *B05C 17/00* (2013.01); *B05B 11/3047* (2013.01); *B05B 11/3052* (2013.01); *A45D 34/042* (2013.01); *B05B 11/3023* (2013.01)

USPC ..... 401/188 R; 401/270

(58) Field of Classification Search

USPC ..... 401/188 R, 270, 278, 261, 263, 264; 417/460, 466, 468, 469

See application file for complete search history.

(56) References Cited

U.S. PATENT DOCUMENTS

| | | | | |
|---|---|---|---|---|
| 4,836,704 | A * | 6/1989 | Roeder | 401/146 |
| 6,200,055 | B1 * | 3/2001 | Fusaro, Jr. | 401/178 |
| 6,309,124 | B1 * | 10/2001 | Gueret | 401/124 |

* cited by examiner

*Primary Examiner* — David Walczak
(74) *Attorney, Agent, or Firm* — Levine Mandelbaum PLLC

(57) ABSTRACT

An airless pump includes a storage unit having inner and outer shells. A head is fastened to the storage unit, wherein the head has a fastening groove and a nozzle. An application unit has the form of a brush and is fastened into the fastening groove so as to allow the content to be applied onto the skin. An airless pump is provided inside the head and connects the storage unit and the nozzle. The airless pump converts the direction of power that has been produced when an operation button is pushed, from the horizontal direction to the vertical direction in order to pump the content from the inner shell. A nozzle opening/closing unit is disposed between the airless pump and the nozzle in order to open/close the nozzle in the same stroke as an operation of the airless pump.

11 Claims, 25 Drawing Sheets

AIRLESS PUMPING TYPE COSMETIC CONTAINER HAVING AN APPLICATOR

BACKGROUND OF THE INVENTION

1. Field of the Invention

The present invention relates, in general, to an airless pumping type cosmetic container having an applicator and, more particularly, to an airless pumping type cosmetic container in which an applicator is provided on the upper portion of a container body consisting of a dual structure, thereby applying the content of the container to be discharged by an airless pump to the user's skin in a convenient, sanitary manner without using the user's hands.

2. Description of the Related Art

Generally, cosmetics made of, for example, gel or cream, are typically used by being contained in dedicated cream cosmetic containers that have relatively wide openings, which are opened/closed by caps, or in tubular cosmetic containers.

Cosmetic cream containers are made of glass or synthetic resin, and are configured such that a user may use cosmetic cream by scooping it out with a finger. Consequently, most such containers have openings that are relatively wide and short.

Accordingly, the user removes a suitable amount of cosmetic cream from inside a container by opening the cap and scooping the cosmetic cream with a finger, and stores the cosmetic cream by closing the container with the cap after having used the cosmetic cream.

However, such a traditional cosmetic cream container does not provide more than the function of simply containing and keeping cosmetic cream therein, and has a structural problem in that it is difficult to create a hermetic seal for the opening when storing the cosmetic cream, since the container is configured such that it is opened/closed using the cap.

There is another problem in that air, impurities, or the like may easily enter the container whenever the content is used, since the container is opened using the cap, thereby polluting or deteriorating the cosmetic cream.

In particular, even if the cosmetic cream is not rapidly polluted or deteriorated, the cosmetic cream easily loses its characteristic perfume or moisture whenever the cap is opened, thereby losing its essential components.

In addition, there are problems in that the cosmetic is wasted, since it is difficult to use the cosmetic cream by removing the required amount with the finger as desired by the user, and that the finger increases the pollution and deterioration of the cosmetic cream through this process.

Another type of cosmetic cream containers in the related art is tubular cosmetic containers.

Tubular containers are made of one selected from among a variety of soft materials, such as aluminum, laminate, and synthetic resin, and are configured such that the content is dispensed out through a relatively narrow orifice when pressure is applied against the surface thereof. Tubular containers are widely used in order to contain not only cosmetics but also a variety of medical supplies having the form of cream, toothpaste, and detergents such as shampoo.

Although such tubular cosmetic containers have advantages in that they can efficiently keep the content and are convenient to use, their external shape must be disadvantageously deformed since the entire volume is reduced in proportion to the amount of content that has been dispensed, attributable to the intrinsic characteristics of the tube.

Specifically, there is a structural problem in that, as the external shape of the tube is gradually crushed in response to the amount of the content that has been used, it becomes impossible for the tube to keep the original external shape, and thus its appearance worsens. Furthermore, due to the deformed external shape, the preservation ability is lowered and it is not easy to handle the tube when using the tube.

In addition to the foregoing problems, the structure in which the opening is opened and closed causes a structural problem in that external air inevitably enters when the tube is being used. Furthermore, due to the structure in which the content is dispensed by compressing the tube, it is difficult to dispense a suitable amount of the content when using the content.

In the meantime, unlike the above-mentioned type cosmetics, cosmetics made of liquid are typically used by being contained in cosmetic containers that have relatively narrow openings, which are opened/closed by caps.

Cosmetic containers are configured such that a user may use the content by dispensing it through the openings after disconnecting the caps from the openings.

However, such cosmetic containers have problems in that the cosmetic is wasted, since it is difficult to precisely dispense a suitable amount of the liquid content, and that like the above-mentioned containers, the cosmetics are polluted or deteriorated and the cosmetics easily lose its characteristic perfume or moisture whenever the cap is opened.

Recently, in order to solve the problems described above, a cosmetic container having a dual structure that includes tubular inner and outer shells, with an airless pump mounted on an opening, was developed. This structure was also proposed by the applicant.

However, although such a cosmetic container has an advantage such as a predetermined amount of content being always dispensed while external pollution sources being basically prevented from entering, there is also an inconvenience in the use thereof, since a user has to directly apply the content that is dispensed through a nozzle onto his/her skin with his/her finger or hand.

In addition, there is another problem in that if the content is applied to the skin using unclean hands, the skin may be infected with bacteria, and if necessary, the content cannot be uniformly applied.

Accordingly in order to solve the foregoing problems, a roller type cosmetic container was proposed in Korean Patent Application No. 2008-135387. This cosmetic container is configured so that a separate roller that idles is mounted to an opening of a tubular storage section so as to make the content, which is being dispensed from the storage section, smeared onto the surface of the roller, allowing the content to be effectively applied onto the user's skin.

However, the conventional roller type cosmetic container has a structural problem that the roller has, since the content is applied onto the skin while being smeared onto the surface of the roller that idles.

That is, although the roller type cosmetic container has all its own merits since the content is applied onto the skin as the roller rolls, it also has a structural problem in that it is difficult to uniformly and smoothly apply the content all over the skin.

In addition, the foregoing patent application also has a problem in that a leakage of water occurs at a particular region such as the tropical region or high pressure region due to a structural problem of an airless pump which is mounted in the cosmetic container.

That is, according to the foregoing patent application, the cosmetic container is configured such that the content to be pumped by a pump is dispensed directly in a vertical direction from a lower side inner shell towards an upper side nozzle, and that a return spring is mounted at the center of the inside of a cylinder in which the content is compressed, thereby causing problems in that the pumping performance and pumping pressure may be reduced due to a vertical dispensing path for the content.

Furthermore, since the conventional cosmetic container has the structure in which the dispensing path connecting the nozzle and the airless pump is opened towards outside, the content remaining in the dispensing path may be polluted and contaminated by air to be introduced from outside.

SUMMARY OF THE INVENTION

Accordingly, the present invention has been made keeping in mind the above problems occurring in the related art, and the present invention is intended to provide an airless pumping type cosmetic container in which an applicator is modified to improve the application efficiency.

The present invention is also intended to provide an airless pumping type cosmetic container having an applicator which is configured such that a nozzle is opened/closed concurrently with the operation of an operation button of an airless pump in order to fundamentally block ambient air or foreign substance from entering, thereby preventing the content of the cosmetic container from being polluted or deteriorated.

The present invention is also intended to provide an airless pumping type cosmetic container having an applicator in which an airless pump is operated such that the power from the pump is transmitted from a horizontal direction to a vertical direction, so that the passage of dispensing the content is decreased to the shortest length, thereby improving the operation accuracy and airtightness of the pump and dispensing performance and accuracy.

The present invention for realizing the foregoing objects is implemented by providing, outside and inside a nozzle, respectively, a separate applicator of a cosmetic container and a nozzle opening/closing unit which is opened/closed by the operation of the pump.

That is, the present invention includes the separate applicator outside the upper side nozzle of the cosmetic container, so that the content dispensed through the nozzle can be conveniently applied without using hands.

In addition, the present invention is configured such that the airless pump and the nozzle opening/closing unit are concurrently operated, so that the nozzle is closed in order to block external impurities and air from entering when the container is not being used, so that the content is prevented from being polluted and deteriorated, and the nozzle opening/closing unit is actuated concurrently with the operation of the pump when the container is used, so as to smoothly dispense the content of the cosmetic container.

Particularly, the present invention is configured such that the airless pump is operated such that the power from the pump is transmitted from a horizontal direction to a vertical direction, so that the passage of dispensing the content is decreased to the shortest length, thereby improving the operation accuracy and airtightness of the pump and dispensing performance and accuracy.

According to the present invention, the applicator is provided on the upper portion of the cosmetic container, so that the content dispended through the nozzle can be uniformly applied onto the user's skin without using hands, thereby improving convenience of use while being beneficial to health.

In addition, according to the nature of the applicator, the content can be effectively applied all over the skin in a smoother, uniform manner.

In addition, the nozzle opening/closing unit, which is actuated to open and close by the operation of the pump, is disposed inside the nozzle, so that ambient air and foreign substance are fundamentally blocked from entering when the cosmetic container is not being used, thereby safely storing the content for a long time.

Particularly, the present invention is configured such that the airless pump is operated such that the power from the pump is transmitted from a horizontal direction to a vertical direction, so that the passage of dispensing the content is decreased to the shortest length, thereby improving the operation performance of the pump and also improving dispensing efficiency due to reduction in the rate of malfunction.

BRIEF DESCRIPTION OF THE DRAWINGS

The above and other objects, features and advantages of the present invention will be more clearly understood from the following detailed description when taken in conjunction with the accompanying drawings, in which.

DETAILED DESCRIPTION OF THE INVENTION

Figure 1:
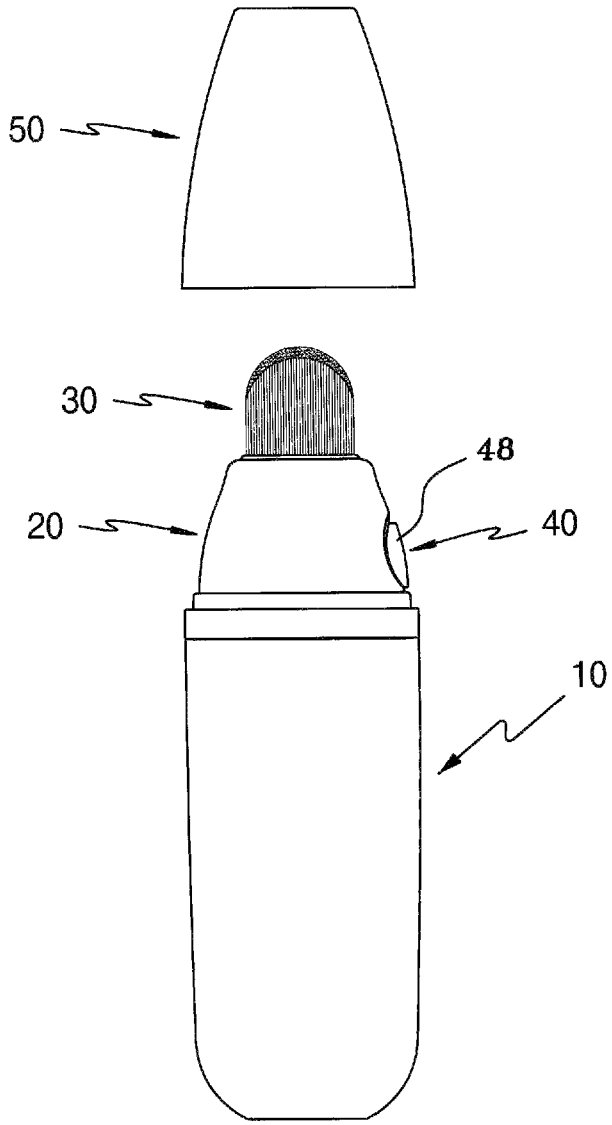
FIG. 1 is a front view of an appearance of a cosmetic container according to the present invention.

Reference will now be made in greater detail to exemplary embodiments of the invention, examples of which are illustrated in the accompanying drawings. Wherever possible, the same reference numerals will be used throughout the drawings and the description to refer to the same or like parts.

Figure 2:
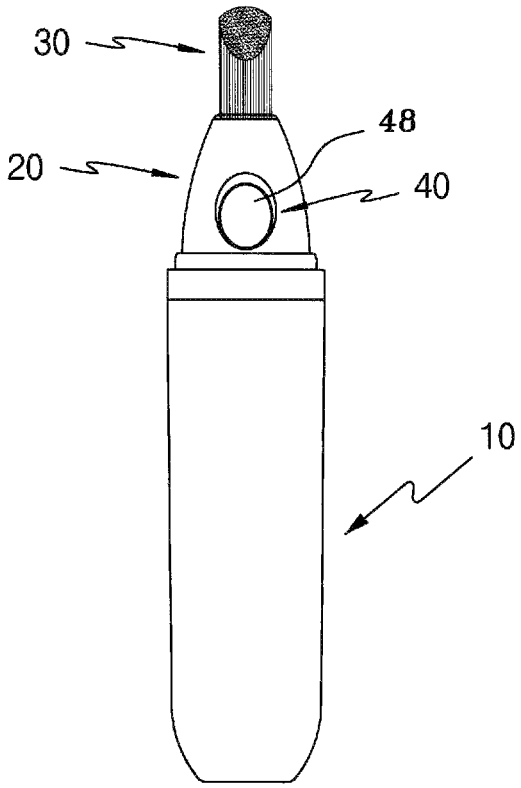
FIG. 2 is a side view of FIG. 1.
Figure 3:
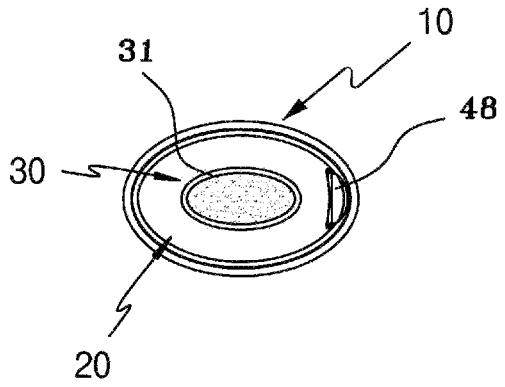
FIG. 3 is a plan view of FIG. 2.
Figure 4:
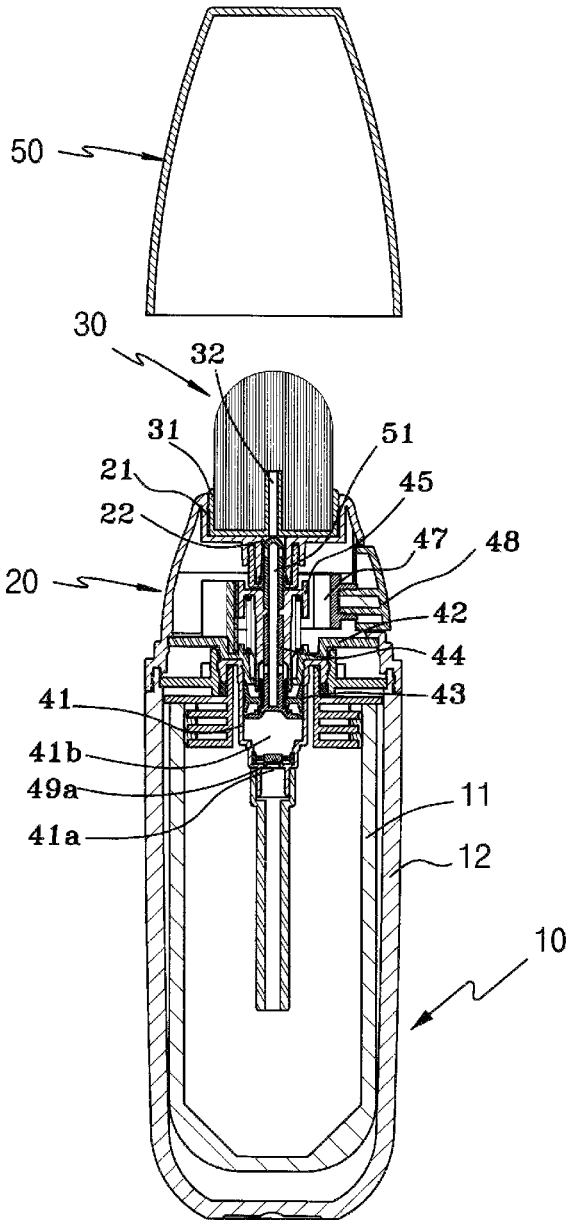
FIG. 4 is a frontal cross-sectional view of FIG. 1.
Figure 5:
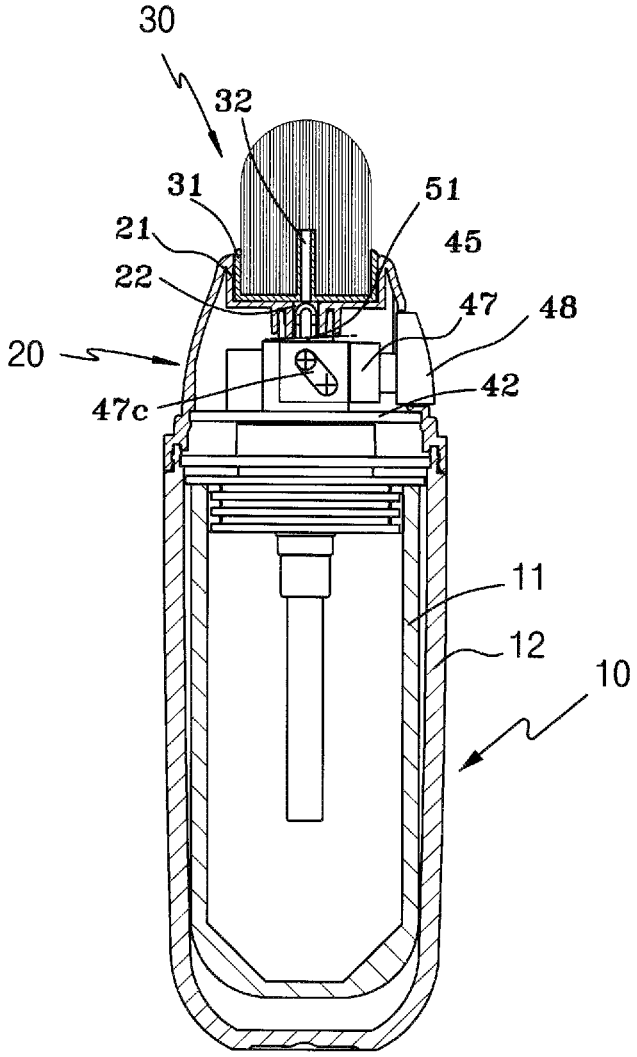
FIG. 5 is a cross-sectional view of the appearance of FIG. 4.
Figure 6:
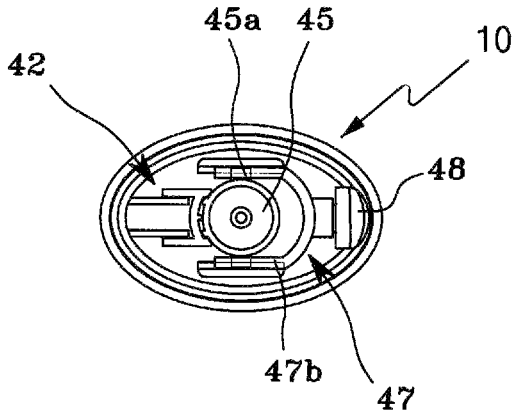
FIG. 6 is a planar cross-sectional view of the major part of FIG. 5.
Figure 7:
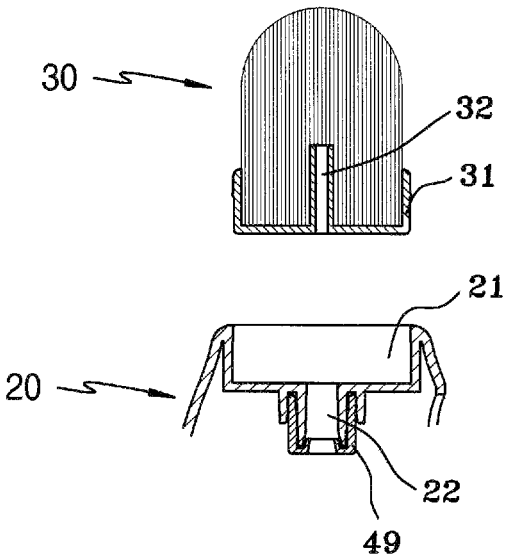
FIG. 7 is a cross-sectional view of an applicator of the cosmetic container according to the present invention.
Figure 8:
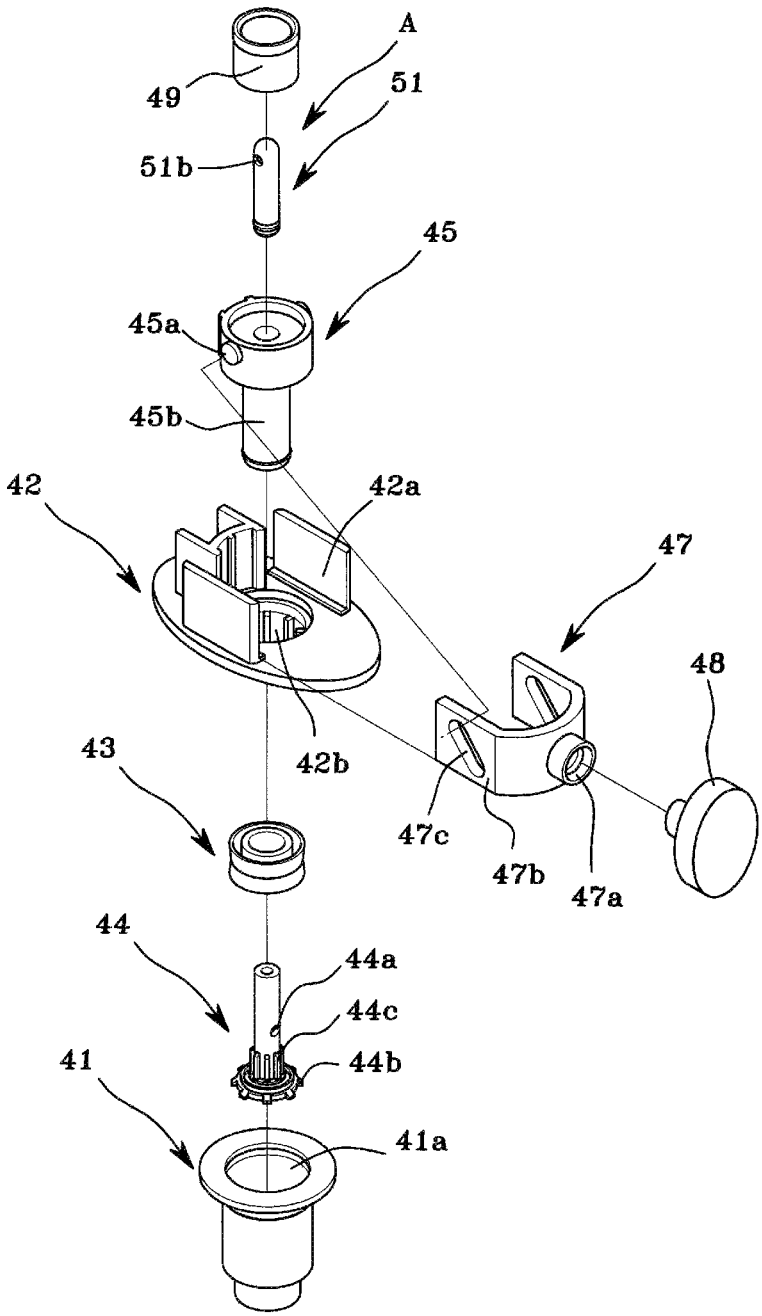
FIG. 8 is an exploded perspective view of a pump of the cosmetic container.
Figure 18:
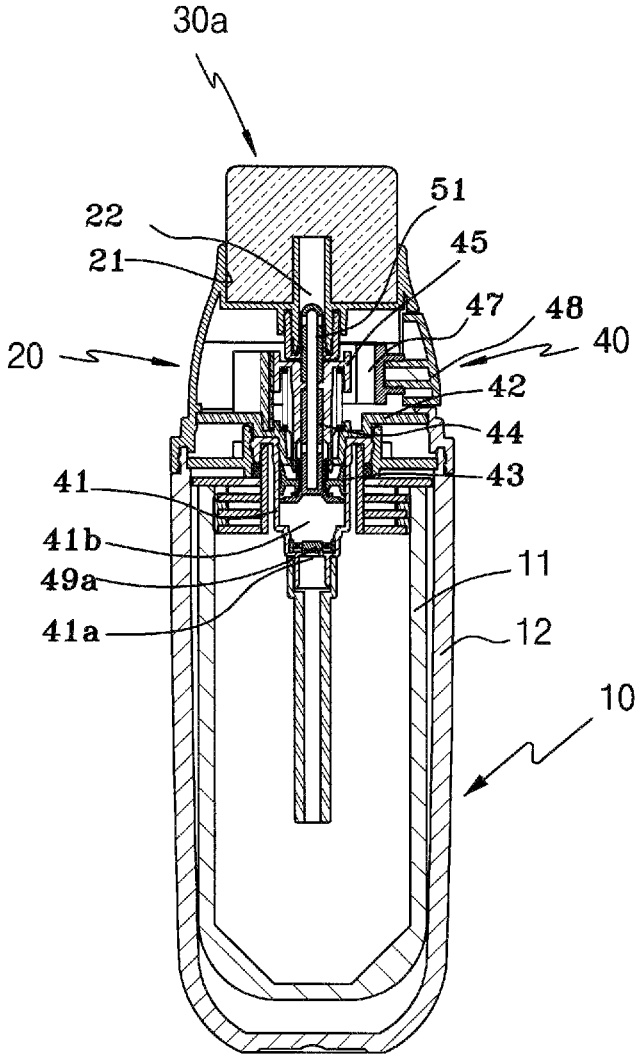
FIGS. 18 to 20 are views of another embodiment of the present invention.

In the accompanying drawings, FIGS. 1 to 3 show the overall structure of the present invention, FIGS. 4 to 9 show the specific components of the present invention in detail, FIGS. 10 to 17 show the overall operation state of the cosmetic container of the present invention, and FIG. 18 and subsequent figures show other embodiments of the present invention.

As shown in the figures, the cosmetic container of the present invention includes a storage unit 10 which is opened and closed by a cap 50, a head 20 which is mounted on the upper portion of the storage unit 10, with a nozzle formed therein, an applicator 30 which is mounted outside the upper portion of the head 20 as an application unit, and an airless pump 40 which is mounted inside the head 20 so as to pump the content of the cosmetic container.

The storage unit 10 is configured as dual container bodies including inner and outer shells, and has a sealed structure so that not only liquid content but also gel or cream content can be safely and effectively stored therein for a long time.

In the storage container 100, the inner shell 11 contains the content therein, and the outer shell 12, which is made of hard material, surrounds the outside of the inner shell 11 to provide a dual body structure so that the container may maintain its overall external shape.

A head 20 having a nozzle is disposed on the upper portion of the outer shell 12, an applicator 30 of application unit is mounted outside the upper portion of the head 20 so as to apply content onto the user's skin, and the airless pump 40 is disposed inside the head.

The inner and outer shells 11 and 12 are made of different materials, such as hard synthetic resin or glass. For example, the inner shell 11 may be made of a material, such as laminate, aluminum, rubber, or synthetic resin, in order to more safely protect the content from direct light or ultraviolet (UV) radiation. The outer shell 12 may be made of a material such as glass or synthetic resin.

The outer shell 12 provides the function of protecting the inner shell 11, and serves to maintain the overall external shape of the container. The outer shell 12 has a variety of forms such as a circle or a rectangle, and is preferably made of a rigid material in order to safely protect the inner shell.

The head 20 is disposed on the upper portion of the outer shell 12.

The head 20 is mounted on the storage unit 10 and has defined therein a space, in which the airless pump 40 is disposed, and the applicator is fastened to the upper portion of the head.

That is, the head 20 is provided on the upper portion thereof with a fastening groove 21 which is open upwards, the nozzle 22 is disposed at the center of the fastening groove 21 such that it is connected to the airless pump 40 so as to dispense the content therethrough, and an installation hole 23 is formed in a portion of the head. An operation button 48 of the airless pump is disposed inside the installation hole.

Thus, the applicator 30 as an application unit is fastened to the upper portion of the head 20, and the airless pump 40 is mounted inside the head.

The applicator has the form of a brush. The applicator 30 is formed as a separate element, and is fixedly inserted into the fastening groove 21 of the head 20 in the state of being contained in a fixing frame 31. The fixing frame 31 is vertically provided at the center thereof with a nozzle passage 32, which is connected with the nozzle 22 of the head 20. The brush may preferably be made of a smooth material such that the content is easily applied.

In addition, the airless pump 40 is configured such that it can be closely fastened to the upper portion of the inner shell 11 within the inner space of the head 20 in order to maintain the inside of the inner shell 11 in a vacuum state.

As shown in the appended figures, the airless pump 40 is configured to seal the orifice, with a compression cylinder 41 thereof fastened into the orifice of the inner shell 11 via a sealing cap 42. A piston valve 43 and a piston 44 are fastened to the interior of the compression cylinder 41.

The compression cylinder 41 has the form of a cylinder, with an opening in the upper end thereof and a dispensing port 41*a* in the lower end thereof. The dispensing port 41*a* is opened and closed by a check valve 49*a*. The compression cylinder 41 has also defined therein a compression chamber 41*b*, which compresses the content.

The body of the compression cylinder 41 stays in the state in which it is completely inserted into the inner shell 11 while a flange in the upper end of the compression cylinder 41 is in close contact with and fastened to the orifice of the inner shell 11, so that the content may be dispensed through the dispensing port 41*a*, which is opened and closed by a check valve 49*a*.

In addition, the sealing cap 42, which fixes the compression cylinder 41, is fixedly disposed between the inner shell 11 and the head 20 in order to provide the function of fixing related components that constitute the airless pump 40.

The sealing cap 42 has guide walls 42*a* in the upper portions thereof, the guide walls 42*a* being formed parallel to each other to guide a slider, which will be described later. The sealing cap 42 also has a center hole 42*b* in the central portion thereof, such that the piston 44 and an operation pipe 45 are vertically fastened into the center hole so that upward and downward motion may be realized.

The piston valve 43 is made of a soft material, such as synthetic resin or rubber, and is fitted into and closely fastened to the inner circumference of the compression cylinder 41. The piston valve 43 serves to dispense the content from the compression chamber 41*b* by compressing it while moving up and down following the upward and downward motion of the piston 44 and the operation pipe 45.

The piston 44 has the form of a cylindrical pipe with an opening in the upper end thereof. A discharge hole 44*a* is formed in the portion of the piston 44 that is in the middle of the longitudinal direction, and communicates with the space inside the piston 44. The lower end of the piston 44 has the shape of a disc that is intended to move up and down along the inner circumference of the compression cylinder 41, and teeth-like blades 44*b* are formed on the outer circumference of the disc.

The upper portion of the piston 44 is interference-fitted into and fixedly fastened to the bottom of the operation pipe 45 to define a dispensing passage through which the content is intended to be dispensed. In this state, the piston 44 moves up and down following the upward and downward motion of the operation pipe 45.

Alternating ribs 44*c* protrude from the surface of the piston 44 in order to facilitate the flow of the content that is dispensed, and the piston valve 43 is mounted around the ribs 44*c* so that it may open and close the spaces between the ribs 44*c* following the upward and downward motion.

In addition, the operation pipe 45 is vertically fastened along the central hole from above the sealing cap 42, and is elastically supported by a spring 46. A nozzle opening/closing unit A, which serves to open and close the nozzle 22, is disposed above the operation pipe 45.

The operation pipe 45 has the form of a cylinder, and has a pair of hinge shafts 45*a*, which extends from opposite outer circumferential portions thereof, and a support 45*b*, which extends down from the lower portion thereof. The operation pipe 45 drives the piston valve 43 to move up and down following the upward and downward motion thereof.

Figure 9:
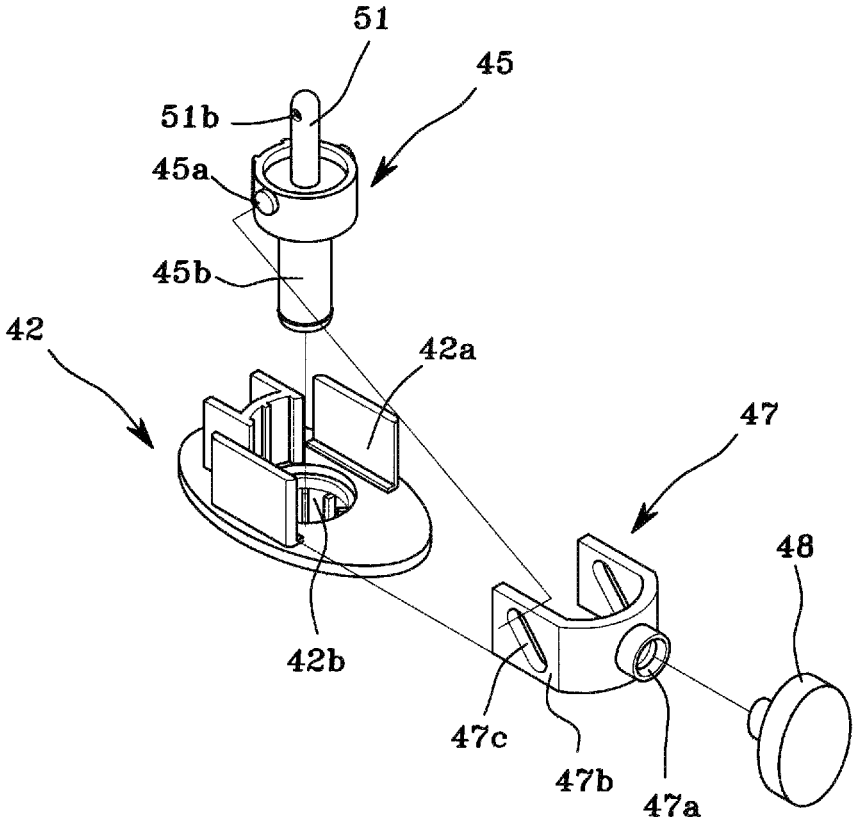
FIG. 9 is an exploded perspective view of a nozzle opening/closing unit shown in FIG. 8.
Figure 10:
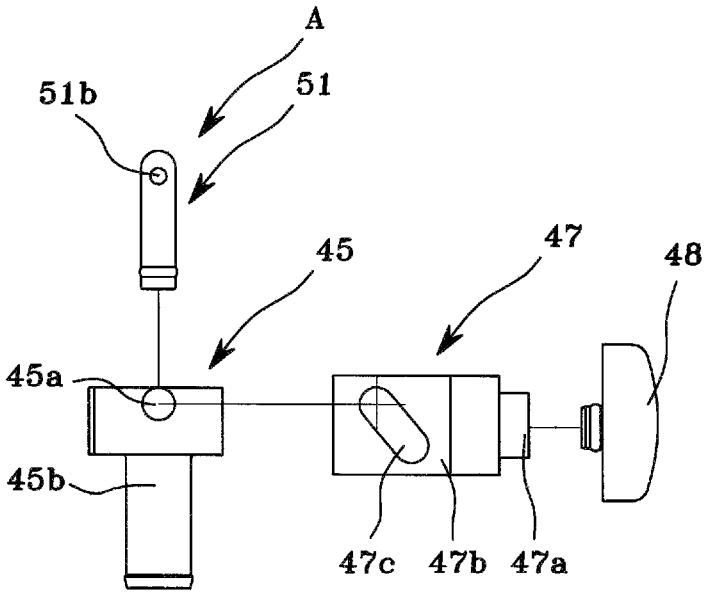
FIGS. 10 to 13 are views explaining the operation of the nozzle opening/closing unit.
Figure 11:
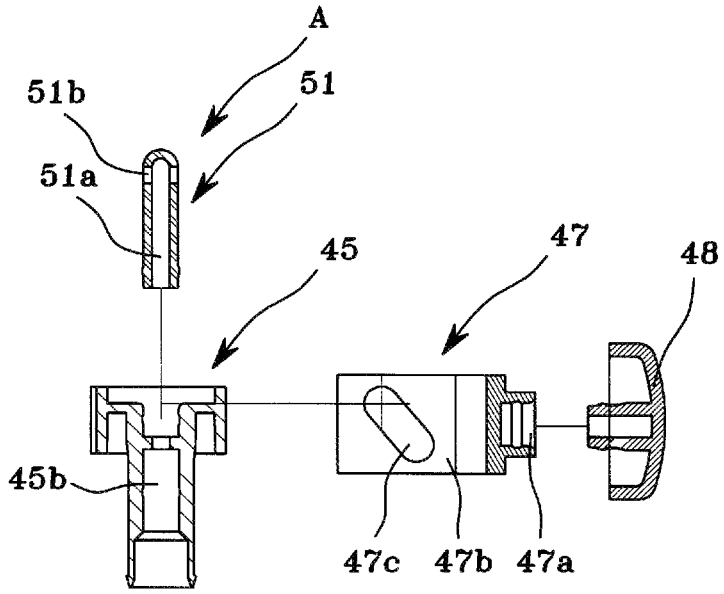
Figure 12:
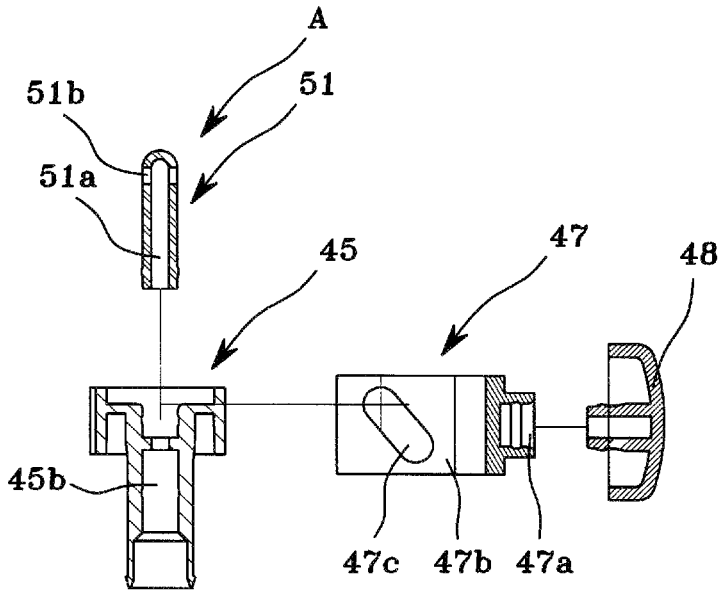
Figure 13:
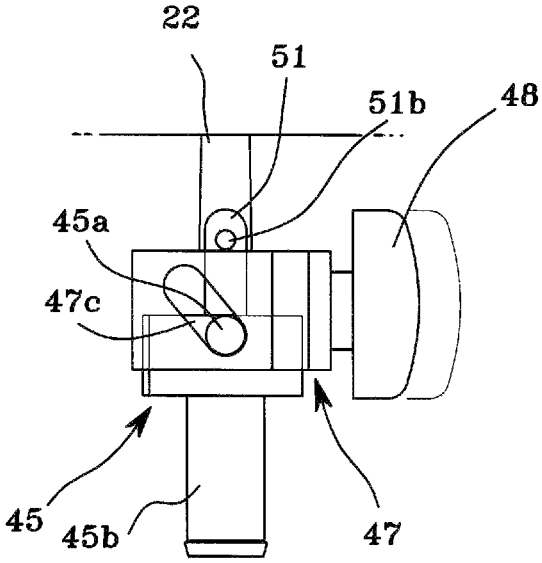
Figure 14:
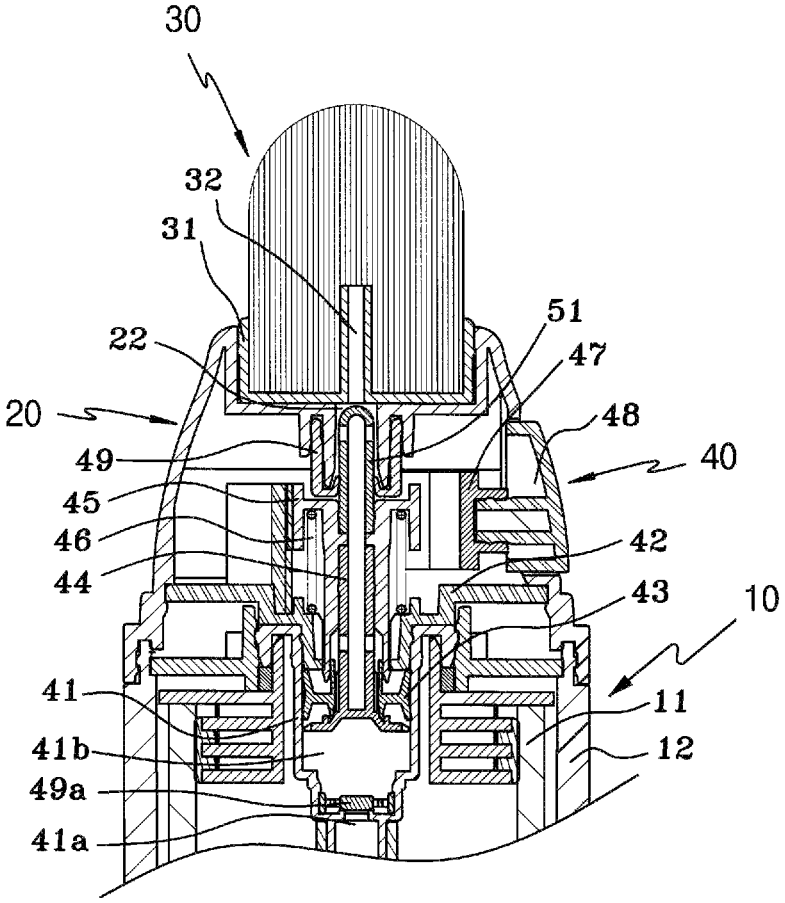
FIGS. 14 to 17 are view explaining the operation of the cosmetic container according to the present invention.
Figure 15:
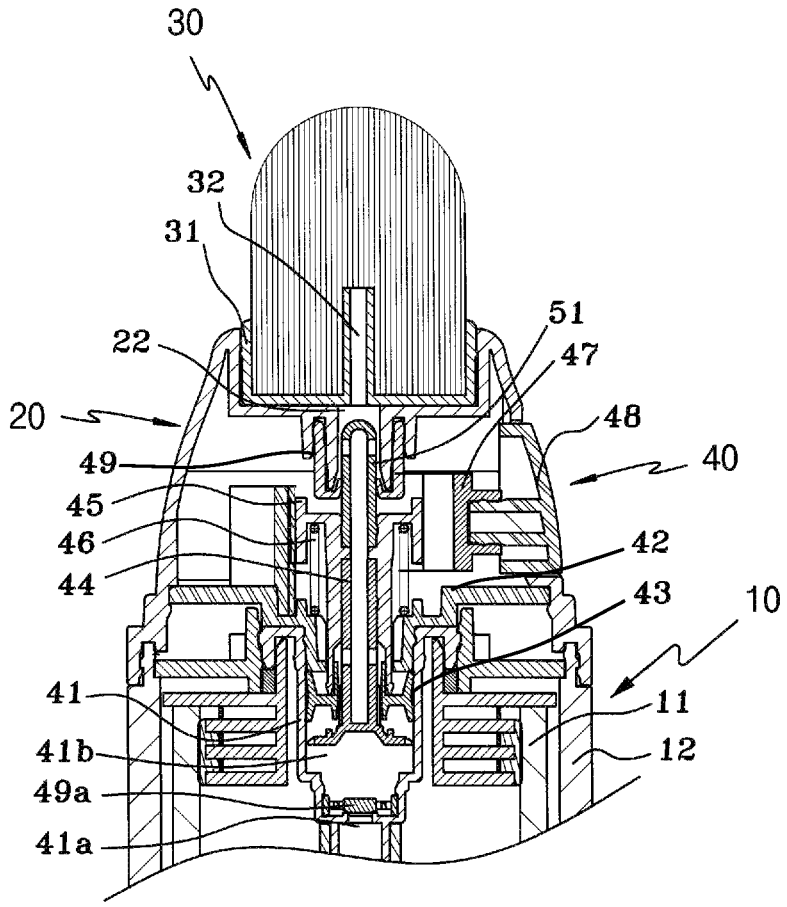
Figure 16:
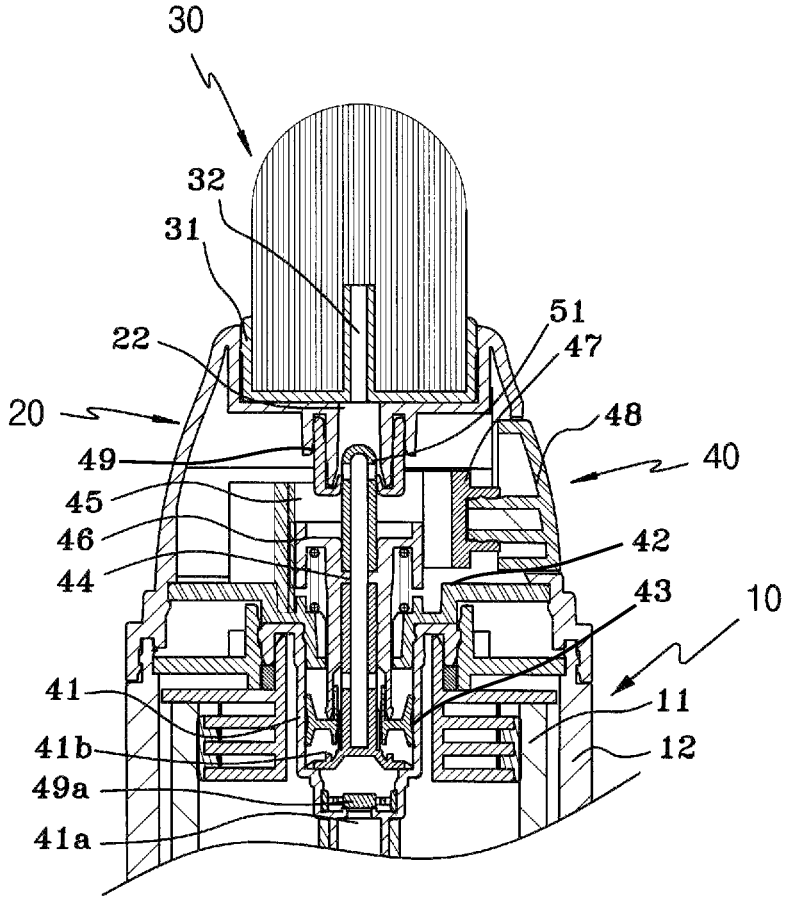
Figure 17:
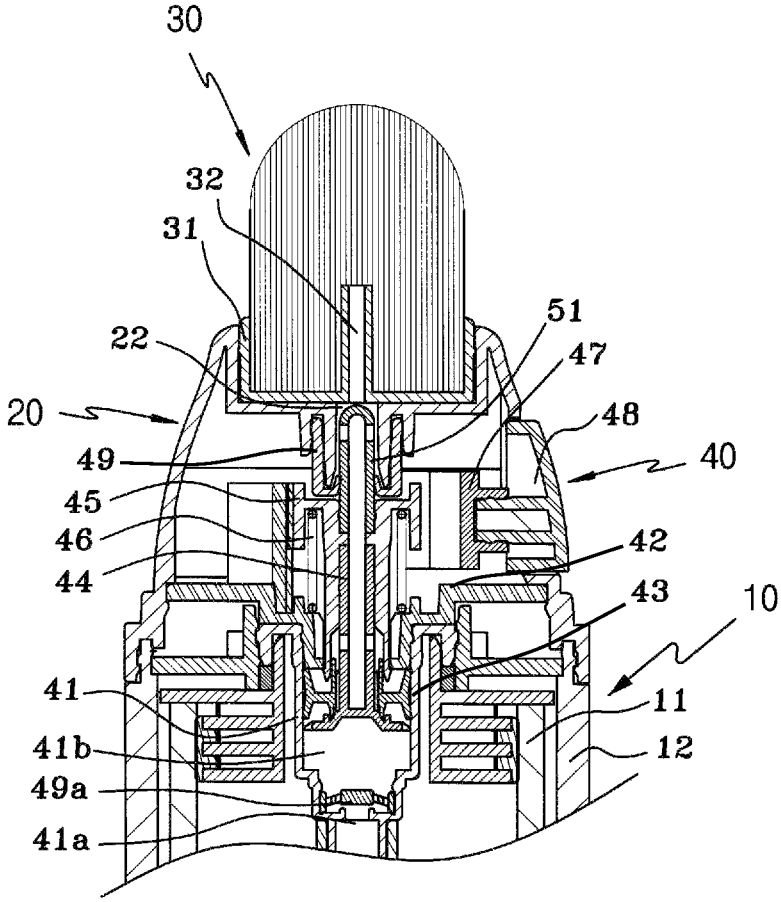

In addition, as shown in detail in FIG. 9, the nozzle opening/closing unit A includes a pipe-like nozzle opening/closing rod 51, which has a dispensing passage 51*a*, with the upper end thereof being hemispherical and the lower end thereof being open. A dispensing hole 51*b* is formed in the upper portion of the nozzle opening/closing rod 51 such that it may communicate with the dispensing passage 51*a* inside the rod 51.

The lower end of the nozzle opening/closing rod 51 is coupled to the upper portion of the operation pipe 45 such that the inner area of the rod 51 communicates with the pipe 45, thereby forming the passage for dispensing the content. The upper end of nozzle opening/closing rod 51 has a hemispherical shape to provide the function of opening and closing the nozzle 22 of the head 20.

In addition, a separate packing 49 is fixedly fastened to the bottom of the nozzle 22 in order to prevent the content from leaking to the outside when the content is dispensed through the nozzle 22. Specifically, the packing 49 has the form of a cylinder, and is fastened to the head 20 such that it surrounds the nozzle 22, thereby providing a hermetic seal between the packing 49 and the nozzle 22. It also provides a hermetic seal to the nozzle opening/closing rod 51, which is fastened into the center hole.

In addition, the slider 47 for transmitting power from the operation button 48 is disposed outside the operation pipe 45 in the horizontal direction. The operation button 48 is fastened to the distal end of the slider 47, and a portion of the operation button 48 is exposed to the outside.

The slider 47 has a fastening hole 47*a* in one side thereof. The operation button 48 is fastened into the fastening hole 47*a*. The slider 47 also has slide wings 47*b* in both sides thereof and shaft slots 47*c*. Each of the shaft slots 47*c* is formed in a respective slide wing 47*b* at an incline of 45°.

The slide wings 47*b* on both sides of the slider 47 are fastened between the guide walls 42*a* on the upper end of the sealing cap 42 such that they reciprocate along the guide walls 42*a*. At the same time, the shaft slots 47*c* are coupled to the hinge shafts 45*a* on both sides of the operation pipe 45, and the operation button 48 is fastened into the fastening hole 47*a*.

The operation button 48 is horizontally oriented through the installation hole 23 of the head 20 when a portion thereof is fastened into the fastening hole 74*a* of the slider 47. In this position, a portion of the operation button 48 is exposed to the outside so that the operation button 48 can be pushed from the outside.

The cosmetic container to which the present invention having the above-described configuration is applied includes the storage unit 10 which is opened and closed by the cap 50, and various types of cosmetics, including gels and creams, can be effectively contained in the inner shell 11 of the storage unit 10.

In addition, the storage unit 10 has a dual structure in which the inner shell 11 ensures that the content are safely contained, and the outer shell 12 protects the inner shell 11 while ensuring that the storage unit maintains its overall external shape. In addition, the storage unit has the configuration in which the head 20 is disposed on the upper portions of the inner and outer shells, the applicator 30 for facilitating to apply dispensing content to the skin is mounted outside the upper portion of the head 20, and the airless pump 40 is mounted in the head in order to forcedly dispense the content to the outside.

Consequently, in the normal state, the inner and outer shells 11 and 12 exhibit the function of safely and efficiently protecting the content from direct light and UV radiation from the outside for a long time thanks to their different materials or dual structure. In addition, the airless pump 40 stops ambient air or external impurities from entering the container, thereby preventing the content from being polluted or deteriorated.

In particular, the present invention may more safely contain the content, since the nozzle 22 formed in the head 20 is tightly closed by the nozzle opening/closing rod 51 so that the air or impurities from the outside are fundamentally blocked from entering.

In this state, when it is desired to use the content, i.e. cosmetics, inside the cosmetic container of the present invention, the cap 50 is removed first, and as shown in FIGS. 14 to 17, the operation button 48 disposed in the installation hole 23 of the head 30 is pushed. In response to the pushing force, the slider 47 moves forwards in the horizontal direction.

The slider 47 is assembled between the guide walls 42*a* of the sealing cap 42, and performs a horizontal reciprocal motion by being guided by the guide walls 42*a*. The slider 47 thus moves forwards following the operation of the operation button 48 that is pushed.

In response to the forward motion of the slider 47, the operation pipe 45 having the hinge shafts 45*a*, which is coupled to the shaft slots 47*c* in the slide wings 47*b*, moves down in the direction perpendicular to that of the slider 47 while compressing the spring 46.

Specifically, the shaft slots 47*c* formed in the slide wings 47*b* of the slider 47 are formed at an incline of 45°, and the hinge shafts 45*a* of the operation pipe 45 are assembled to the shaft slots 47*c* in the direction crossing the longitudinal direction of the shaft slots 47*c*. Thus, horizontal power that occurs in response to the reciprocal operation of the slider 47 is changed in the vertical direction so as to allow the operation pipe 45 to move up and down.

When the operation pipe 45 moves down as described above, the nozzle opening/closing rod 51, which is coupled to the operation pipe 45 from above, moves down in the same stroke to open the nozzle 22 while concurrently actuating the airless pump 40.

Specifically, first, the downward motion of the operation pipe 45 moves down the piston 44, which is coupled to the bottom of the operation pipe 45. The piston 44, while moving down, compresses the compression chamber 41*b* in the compression cylinder 41 while being separated from the piston valve 43, thereby opening the dispensing passage through which the content is dispensed out.

Here, as the operation pipe 45 moves down, the piston 44 moves down before the piston valve 43. Subsequently, the support 45*b* of the operation pipe 45 causes the piston valve 43 to sequentially move down, thereby compressing the compression chamber 41*b*.

Consequently, the sequential downward motion of the piston 44 and the piston valve 43 drives the content that has entered the compression chamber 41*b* toward the upper side of the piston valve 43 through the spaces between the lower blades 44*b* and between the ribs 44*c* of the piston 44.

Afterwards, the content is fed into the piston 44 through the discharge hole 44*a* in the piston 44, and is then dispensed to the outside through the dispensing passage 51*a* and dispensing hole 51*b* of the nozzle opening/closing rod 51 and through the nozzle 22.

Here, in the compression mode described above, the check valve 49*a* maintains the dispensing port 41*a* in the closed position.

The content that is dispensed to the upper portion of the head 20 through the nozzle 22 sinks into the brush of the applicator 30 through the nozzle passage 32 which is formed in the center of the fixing frame 31 of the applicator 30, which is connected to the nozzle in a straight line.

Thus, when the user uniformly rubs the applicator 30 in the form of a brush over the skin that is intended to be applied, the content that was sunk into the brush of the applicator is applied onto the skin. When such an operation is successively performed, the content can be easily applied onto the skin without using fingers.

In reverse to the above-described operation, when the operation button 48 is released from the pressed position, the operation pipe 45 is moved up to the original position by the restoring force of the spring 46. Consequently, the nozzle opening/closing rod 51 is also moved up in the same stroke, so that the upper end of the rod 51 closes the nozzle 22.

At the same time, the piston 44 connected to the bottom of the operation pipe 45 is also actuated to move up to its original position, thereby sequentially driving the piston valve 43 upwards. Consequently, the compression chamber 41*b* within the compression cylinder 41 expands and generates a strong pressure.

Specifically, the piston 44, while moving up, closes the dispensing passage defined between itself and the piston valve 43, so that the strong pressure generated in the compression chamber 41*b* by the upward motion of the piston 44 causes the check valve 49*a* to open the dispensing port 41*a*. As a result, the content in the inner shell 11 is introduced into the compression chamber 41*b*, where the content stands by for the next operation.

In the meantime, as the operation pipe 45 moves up, the slider 47 coupled to the hinge shafts 45*a*, which are disposed on the outer portions of the operation pipe 45, is actuated to move backwards in the horizontal direction along the inclined shaft slots 47*c*, and is then returned to its original position through the next operation.

Accordingly, by repeating the operation of pushing the operation button 48 as described above, the airless pump 40 disposed inside the head 20 is actuated to dispense a predetermined amount of the content from inside the inner shell 11.

That is, when the container is not used, the nozzle 22 may stay in the closed state, thereby fundamentally blocking air as well as impurities from entering from the outside. When using the container, it is possible to actuate the pump and concurrently open the nozzle by simply pushing the operation button, so that the content can be dispensed through the nozzle, thereby facilitating the use of the cosmetic container.

Figure 19:
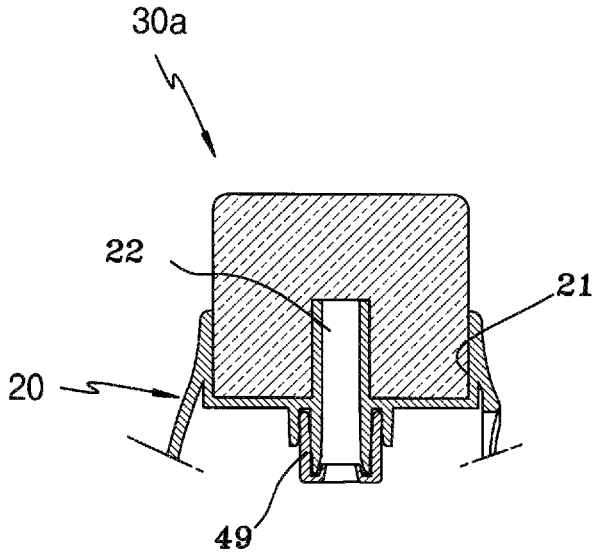
Figure 20:
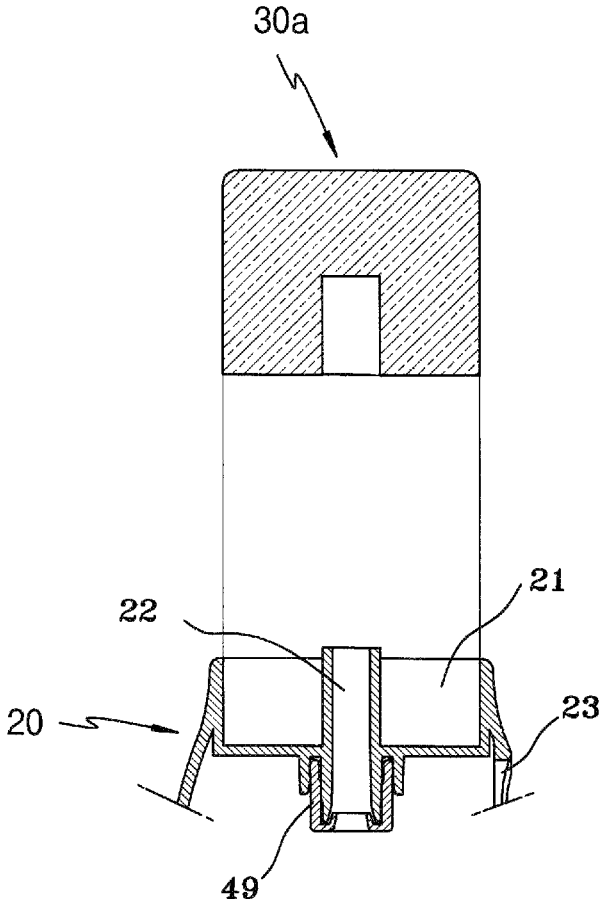

In the meantime, appended FIGS. 18 to 20 show another embodiment of the applicator.

In the embodiment, the applicator 30*a* is made of a sponge material, and is inserted into and fastened to the fastening groove 21 of the head 20.

In this case, the content dispensed through the nozzle 22 sinks into the sponge-like applicator, so that the content can be applied onto the skin by tapping the applicator 30*a* against desired skin, thereby conveniently applying cosmetics onto the skin without using hands.

Figure 21:
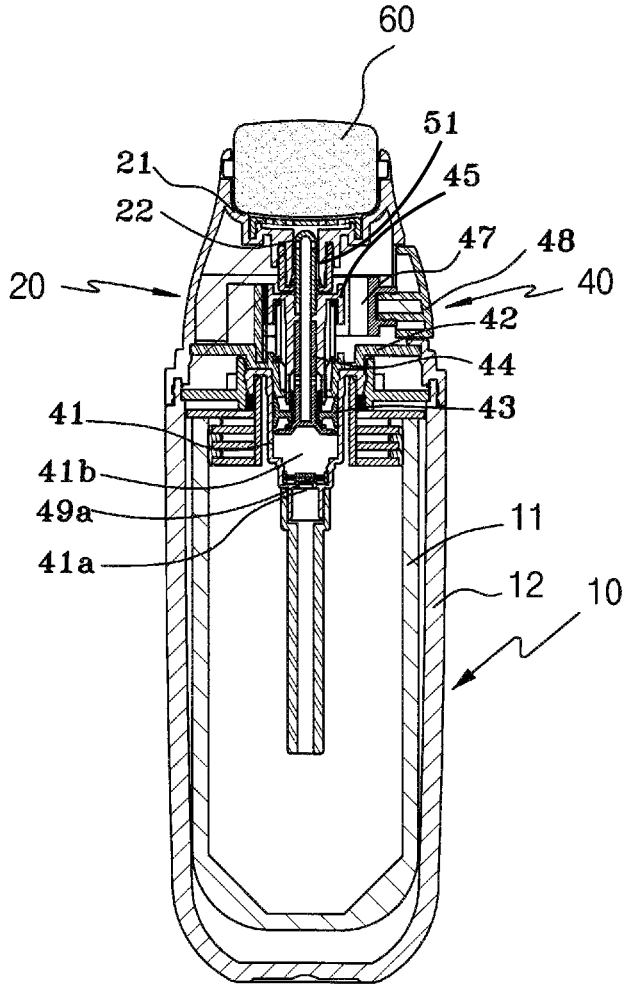
FIGS. 21 to 26 are views of a further embodiment of the present invention.
Figure 22:
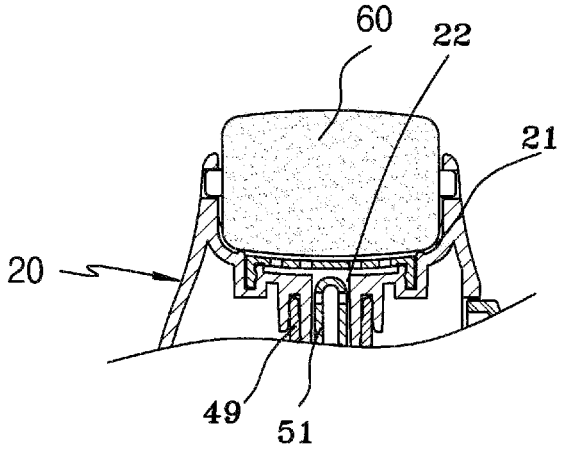
Figure 23:
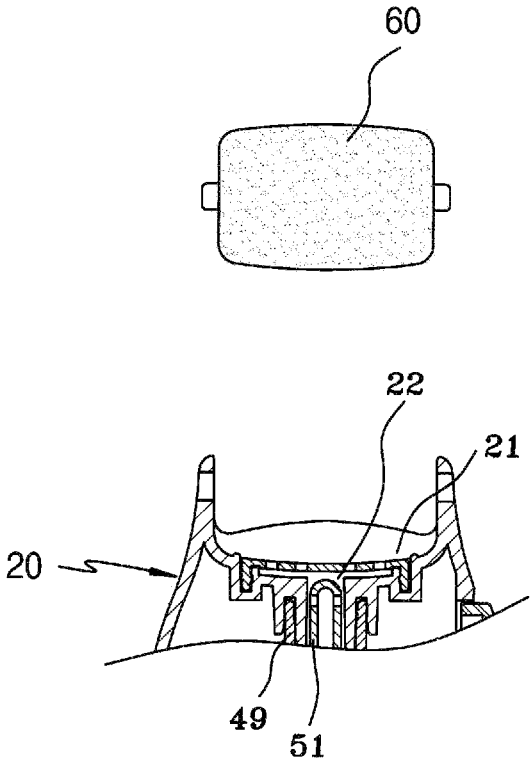

FIGS. 21 to 23 show a further embodiment of the present invention.

In this embodiment, the applicator is configured to have the form of a roller. Unlike a conventional roller type applicator, the present roller type applicator is configured such that a roller 60 is disposed on the upper portion of the head 20 such that it can idle, and an airless pump 40 having a new structure is mounted inside the head 20 such that it is organically coupled to the roller.

That is, the provision of the sponge-like roller 60 of the application unit, which is disposed on the upper portion of the head 20 of the cosmetic container having the airless pump 40 such that it can idle, can improve the pumping and application efficiencies of the content.

Figure 24:
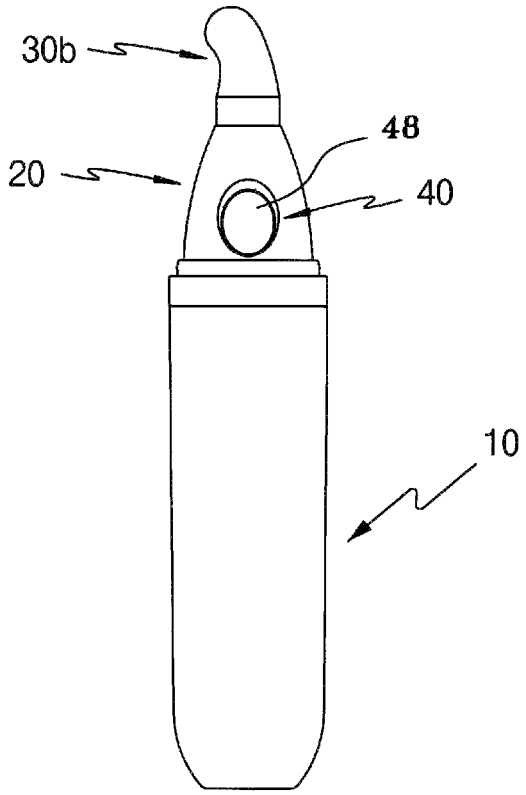
Figure 25:
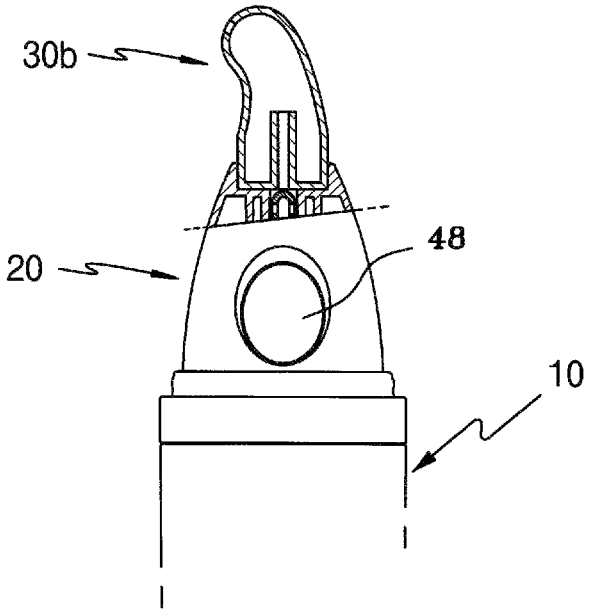
Figure 26:
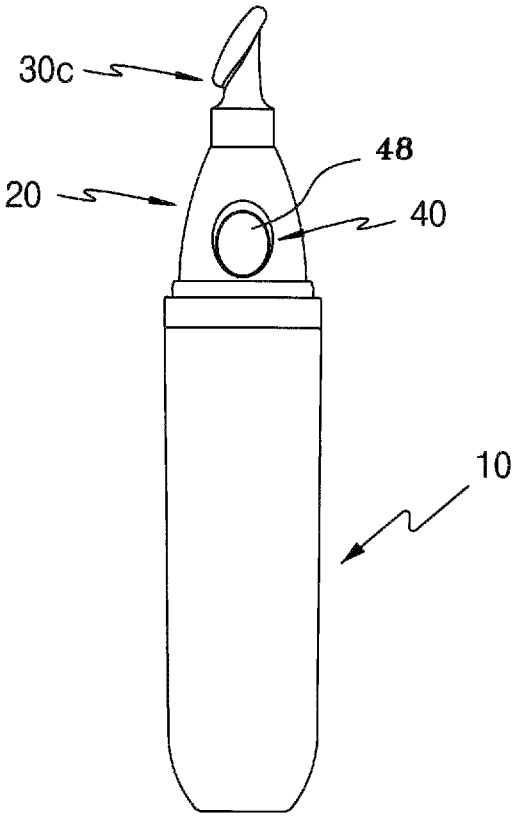

In addition, FIGS. 24 to 26 show a further embodiment of the present invention.

In this embodiment, the applicator is configured to have the form that can perform a massage function. That is, the applicator 30*b* or 30*c* has a convex shape in order to rub itself over the skin so as to apply the content onto the skin while massaging the skin.

The shape of the above-mentioned applicator 30*b* or 30*c* is not limited to that shown in the figures, but may have a variety of convex forms which are expected to provide the same effect.

Although the exemplary embodiments of the present invention have been described for illustrative purposes, those skilled in the art will appreciate that various modifications, additions and substitutions are possible, without departing from the scope and spirit of the invention as disclosed in the accompanying claims.

What is claimed is:

1. A cosmetic container comprising:

a storage unit having inner and outer shells made of different materials and forming a dual body structure, said inner shell being adapted to contain content therein, said outer shell surrounding said inner shell and being rigid for protecting said inner shell and maintaining the shape of said container;

a head fastened to an upper portion of the storage unit, wherein the head has a fastening groove in an upper portion thereof and a nozzle formed in a central portion of the fastening groove;

an application unit fastened into the fastening groove so as to allow the content dispensed through the nozzle to be applied onto skin;

an airless pump provided inside the head and connecting the storage unit and the nozzle, wherein the airless pump converts the direction of power that has been produced when an operation button is pushed, from the horizontal direction to the vertical direction in order to pump the content from the inner shell, said airless pump maintaining said inner shell in a vacuum state; and a nozzle opening/closing unit disposed between an upper portion of the airless pump and the nozzle in order to open/close the nozzle in the same stroke as an operation of the airless pump.

2. The cosmetic container according to claim 1, wherein the application unit comprises a brush type applicator, which is mounted by a fixing frame, wherein a nozzle passage connected to the nozzle is disposed at the center of the fixing frame such that upper and lower portions of said container communicate with each other, thereby allowing the content dispensed through the nozzle to sink into the applicator.

3. The cosmetic container according to claim 1, wherein the application unit is configured such that an applicator thereof is detachably inserted into the fastening groove of the head.

4. The cosmetic container according to claim 1, wherein the application unit is configured such that an applicator thereof is made of a unitary sponge-like material to be inserted into the fastening groove of the head, thereby using the applicator while tapping itself against the skin for the application of the content.

5. The cosmetic container according to claim 1, wherein the application unit is configured such that an applicator thereof has a convex shape that is able to perform a massage function while being rubbed over the skin.

6. The cosmetic container according to claim 1, wherein the application unit is configured such that an applicator thereof comprises a sponge-like roller which is fastened to the upper portion of the head such that the roller is able to idle.

7. A cosmetic container comprising:

a storage unit having inner and outer shells and adapted to contain content therein;

a head fastened to an upper portion of the storage unit, wherein the head has a fastening groove in an upper portion thereof and a nozzle formed in a central portion of the fastening groove;

an application unit fastened into fastening groove so as to allow the content dispensed through nozzle to be applied onto skin;

an airless pump provided inside the head and connecting the storage unit and the nozzle, wherein the airless pump converts the direction of power that has been produced when an operation button is pushed, from the horizontal direction to the vertical direction in order to pump the content from the inner shell; and a nozzle opening/closing unit disposed between an upper portion of the airless pump and the nozzle in order open/close the nozzle in the same stroke as an operation of the airless pump, wherein the nozzle opening/closing unit includes a nozzle opening/closing rod fixedly fastened to an operation pipe above the airless pump in the vertical direction, wherein the nozzle opening/closing rod comprises a pipe having a hemispherical upper end and an open lower end, the pipe of the nozzle opening/closing rod defining a dispensing passage therein, wherein a dispensing hole communicating with the dispensing passage is formed in an upper portion of the nozzle opening/closing rod, so that the nozzle opening/closing rod is actuated to move up and down in the same stroke as upward and downward motion of the airless pump in order to open and close the nozzle.

8. A cosmetic container comprising:

a storage unit having inner and outer shells and adapted to contain content therein;

a head fastened to an upper portion of the storage unit, wherein the head has a fastening groove in an upper portion thereof and a nozzle formed in a central portion of the fastening groove;

an application unit fastened into the fastening groove so as to allow the content dispensed through the nozzle to be applied onto skin;

an airless pump provided inside the head and connecting the storage unit and the nozzle, wherein the airless pump converts the direction of power that has been produced when an operation button is pushed, from the horizontal direction to the vertical direction in order to pump the content from the inner shell; and wherein the airless pump comprises:

a compression cylinder disposed between the inner shell and the nozzle inside the head, wherein the compression cylinder has a compression chamber, and is fastened to an opening of the inner shell in a hermetic manner;

a sealing cap fixing the compression cylinder;

a piston valve and a piston fastened into the compression chamber inside the compression cylinder;

an operation pipe disposed above the sealing cap in a vertical direction along a central hole on an upper portion of the sealing cap, wherein the operation pipe is actuated to move up and down, thereby driving the piston and piston valve to move up and down;

a spring disposed between the operation pipe and the sealing cap; and a slider axially coupled to the operation pipe in a direction perpendicular to the operation pipe, wherein the slider is actuated by the operation button to horizontally reciprocate, thereby driving the operation pipe to move up and down, in order to pump the content in the inner shell towards the nozzle, and a nozzle opening/closing unit disposed between an upper portion of the airless pump and the nozzle in order to open/close the nozzle in the same stroke as an operation of the airless pump.

9. The cosmetic container according to claim 8, wherein the sealing cap is fastened into an opening of the inner shell, wherein the sealing cap has guide walls in upper portions thereof, the guide walls being formed parallel to each other, the slider fastened to the guide walls such that the slider is movable back and forth, and wherein the piston and the operation pipe are vertically inserted and fastened into the center hole of a central portion, thereby realizing upward and downward motion.

10. The cosmetic container according to claim 8, wherein the operation pipe is fastened into the sealing cap such that the operation pipe is actuated to move up and down, and has a hinge shaft on an outer circumference thereof and a support rod integrally formed in a lower portion thereof, the support rod actuating the piston valve, whereby the operation pipe is actuated to move up and down in response to reciprocal motion of the slider.

11. The cosmetic container according to claim 8, wherein the slider has a fastening hole in a portion thereof, the operation button being fastened into the fastening hole, and slide wings in both sides thereof, the slide wings being guided along guide walls of the sealing cap, wherein a shaft hole is formed in each of the slide wings at an incline of 45° such that a hinge shaft of the operation pipe is coupled to the shaft hole, wherein the slider converts the direction of a force that has been horizontally applied by the operation button to the vertical direction, thereby actuating the operation pipe to move up and down.

* * * * *